US010792943B2

(12) United States Patent
Kaneoya

(10) Patent No.: US 10,792,943 B2
(45) Date of Patent: Oct. 6, 2020

(54) RECORDING APPARATUS

(71) Applicant: Daisuke Kaneoya, Yamanashi-ken (JP)

(72) Inventor: Daisuke Kaneoya, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 7 days.

(21) Appl. No.: 16/204,589

(22) Filed: Nov. 29, 2018

(65) Prior Publication Data

US 2019/0168524 A1 Jun. 6, 2019

(30) Foreign Application Priority Data

Dec. 1, 2017 (JP) ..... 2017-231800

(51) Int. Cl.

| | |
|---|---|
| ***B41J 2/32*** | (2006.01) |
| ***B41J 29/17*** | (2006.01) |
| ***B41J 3/28*** | (2006.01) |
| ***B41J 13/12*** | (2006.01) |
| ***B41J 2/005*** | (2006.01) |
| ***B41J 29/38*** | (2006.01) |

(52) U.S. Cl.

CPC ..... *B41J 29/17* (2013.01); *B41J 2/0057* (2013.01); *B41J 2/32* (2013.01); *B41J 3/28* (2013.01); *B41J 13/12* (2013.01); *B41J 29/38* (2013.01)

(58) Field of Classification Search

CPC ..... B41J 2/0057; B41J 2/32; B41J 3/28; B41J 13/12; B41J 29/38; B41J 29/17

See application file for complete search history.

(56) References Cited

U.S. PATENT DOCUMENTS

2003/0207078 A1* 11/2003 Finn ..... G03G 15/2057 428/124

FOREIGN PATENT DOCUMENTS

| | | |
|---|---|---|
| JP | 2012-121645 A | 6/2012 |
| JP | 2014-054751 A | 3/2014 |

* cited by examiner

*Primary Examiner* — Lamson D Nguyen

(74) *Attorney, Agent, or Firm* — Manabu Kanesaka

(57) ABSTRACT

The present invention is to provide a recording apparatus capable of cleaning the surface of a medium such as a card at each time before and after image transfer, in a transport path to which is fed a card ejected from a media supply C, and a cleaning section that performs cleaning by nipping the card with a pair of contact rollers to pass through. In the transport path, when the card is transported to the transfer section by driving roller pairs and contact rollers, the card prior to transfer is cleaned. After transfer processing in the transfer section, the card is transported in the opposite direction to pass through the cleaning section again, and is transported to the discharge section D, and the card subsequent to transfer is thereby cleaned.

8 Claims, 7 Drawing Sheets

RECORDING APPARATUS

TECHNICAL FIELD

The present invention relates to a recording apparatus for transferring images to surfaces of recording media such as plastic cards and cardboard cards via a transfer film.

BACKGROUND ART

Generally, this type of recording apparatus is used in recording images on various kinds of certificate cards and payment card, and the like. As a recording method in this case, the method is performed by bringing a transfer film on which are printed images of, for example, a face photo, full name, name and the like into press-contact with the card using a heating member and transfer platen, and thereby transferring the image of the transfer film to the surface of the card.

In such a recording apparatus, when dust and the like adhere to the surface of the stored card provided for transfer and the surface is dirty, the transfer is sometimes incomplete. Therefore, it is conducted that the card is fed to a transfer section, after removing dust on the surface of the card before transfer (for example, see Patent Document 1).

However, even after transfer, when soil generated by the transfer remains on the card surface, the card is poor in finish in terms of the aesthetic purpose. Particularly, when the transfer film is peeled off from the card surface after transfer, it happens often that the transfer film is not completely peeled off, and that a part thereof remains as a film residue.

Further, in a card generation apparatus where after a card is fed in between a heat roller and a backup roller, is overlapped on the surface protective film side of a transfer ribbon to heat, and the surface protective film is transferred to the card surface, the transfer ribbon and the surface protective film are peeled off to integrate the surface protective film onto the card, and the card is thereby generated, it is known removing a burr of the protective film transferred to the card (for example, see Patent Document 2).

PRIOR ART DOCUMENT

Patent Document

[Patent Document 1]
Japanese Patent Application Publication No. 2012-121645
[Patent Document 2]
Japanese Patent Application Publication No. 2014-054751

DISCLOSURE OF INVENTION

Problems to be Solved by the Invention

However, in the card generation apparatus of Patent Document 2, the burring processing is performed so as to arrange the finish of the card after transfer, and is not to remove the stain and dust left on the surface of the card. Accordingly, desired is a recording apparatus that removes the stain, dust and the like adhering to the surface of the card before and after transfer, but providing cleaning sections that clean the surface of the card at the front and back of the transfer section results in upsizing of the apparatus, and also leads to increase in cost.

In terms of the foregoing respect, it is an object of the present invention to provide a recording apparatus where a cleaning section is efficiently arranged so that the single cleaning section is capable of cleaning a surface of a medium such as a card both prior to and subsequent to image transfer.

Means for Solving the Problem

In order to attain the above-mentioned object, in the present invention, in a recording apparatus for bringing a transfer film with an image formed into press-contact with a medium and thereby transferring the image to the medium, the apparatus is characterized by being provided with a media supply section that supplies the medium, a cleaning section that cleans the medium, a transfer section that provides transfer processing on the medium, a discharge section to which the medium is discharged, media transport means for transporting the medium, and a control section that controls the media transport means, where the control section controls the media transport means so as to transport the medium from the media supply section to the transfer section via the cleaning section, and to transport the medium to the discharge section via the cleaning section after the transfer processing by the transfer section.

In this case, it is preferable that the cleaning section is disposed between the media supply section and the transfer section and on the downstream side in the media transport direction in the transfer processing by the transfer section. By this means, it is possible to shorten a transport path of the card, and it is possible to downsize the apparatus and reduce the processing time. As one Embodiment, the control section controls to transport the medium from one side of the cleaning section at the time of supplying the medium, and to transport the medium from the other side of the cleaning section after the transfer processing, and downsizing of the apparatus and speeding up of the processing time is thereby remarkable.

In addition thereto, the media transport means is disposed on opposite sides of the cleaning section at least in the transport direction of the medium, the control section is configured to transport the medium until an upstream-side end portion of the medium in the transport direction passes through the cleaning section, and it is thereby possible to clean up to the end portion of the card.

Further, in another Embodiment, a reverse section for reversing the transport direction of the medium to transport is provided, and the cleaning section is disposed between the reverse section and the transfer section. By this means, since there is a possibility that a transfer residue separates from the card by the behavior of the card changing in the reverse section, cleaning is capable of being performed prior thereto, and is effective.

Then, when the supply section is disposed above the reverse section, and the discharge section is disposed on the side opposite to the cleaning section with the reverse section therebetween, it is possible to discharge the card with the transfer processing provided to the discharge section directly, and the processing efficiency is increased.

In this case, the control section may be configured to transport the medium from the media supply section and discharge to the discharge section through the reverse section, the cleaning section, the transfer section, the cleaning section and the reverse section.

Further, in further another Embodiment, it is configured that the reverse section includes a transport roller that transports the medium, and that a surface of the transport roller includes stickiness, and the transport roller is thereby made the cleaning section. Accordingly, in this Embodiment, the transport roller of the reverse section also serves as the cleaning member, and downsizing of the apparatus is further achieved.

It is suitable that the cleaning section is provided with a re-removal member for removing adhering dust, and cleaning performance is thereby improved.

Advantageous Effect of the Invention

According to the recording apparatus according to the present invention, by cleaning a medium such as a card before transfer processing, and cleaning the medium also after the transfer processing, both the dust from the outside and the transfer residue is cleaned, and it is thereby possible to provide the medium rich in finish of transfer. Further, the cleaning prior to and subsequent to the transfer processing is performed in the same cleaning section, and it is thereby possible to actualize downsizing of the recording apparatus.

MODE FOR CARRYING OUT THE INVENTION

Figure 1:
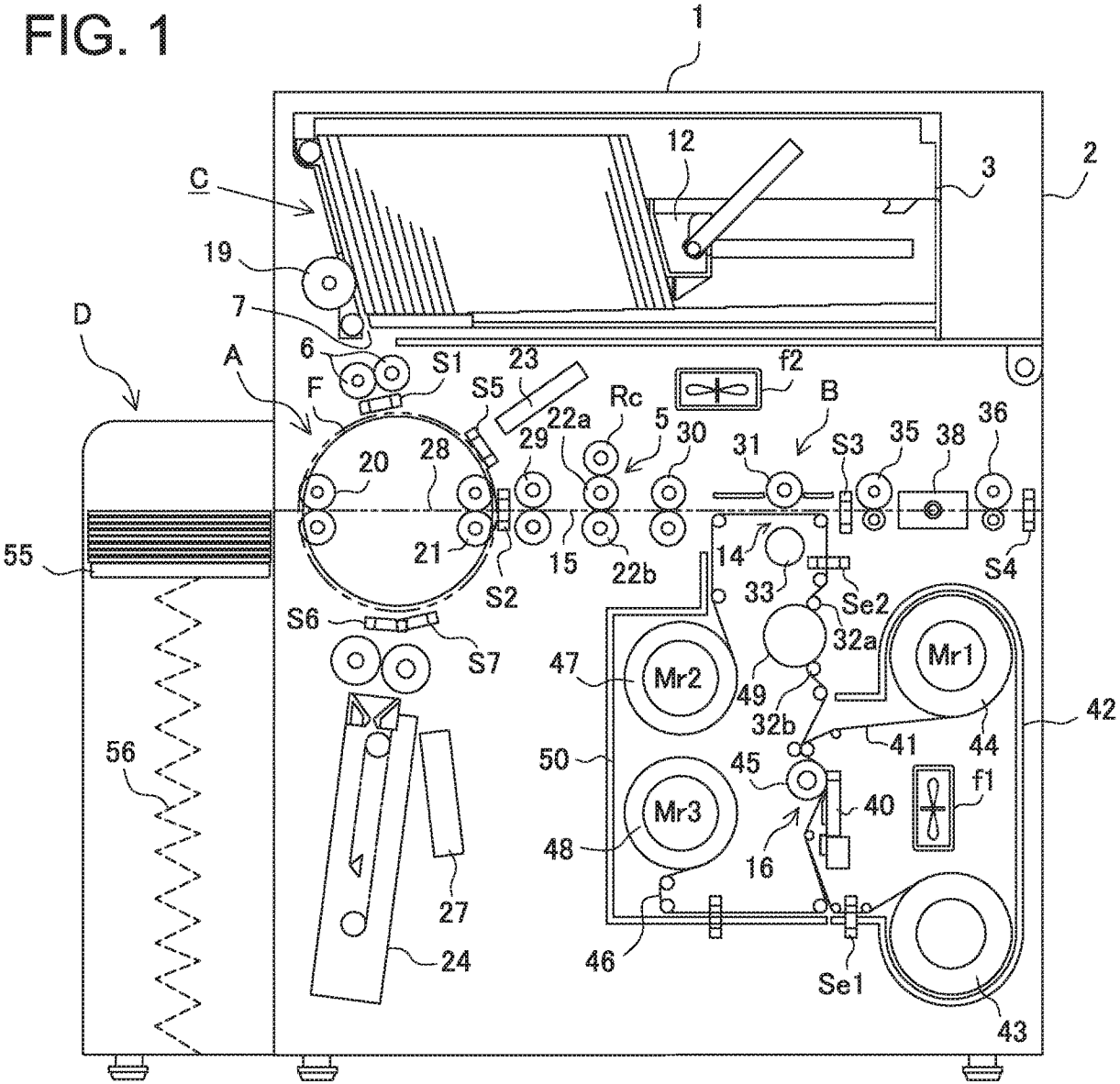
FIG. 1 illustrates an entire configuration view of a recording apparatus according to Embodiment 1 of the present invention.

The present invention will be described below in detail based on preferred Embodiments shown in drawings. FIG. 1 is an explanatory view of the entire configuration of a recording apparatus 1 according to Embodiment 1 of the present invention. In order to prepare ID cards for various kinds of certificates and credit cards for business transactions, the recording apparatus 1 is a card processing apparatus which records information on the card electronically or magnetically, while recording images on the surface of the card by thermal transfer. In a housing 2 are provided an information recording section A, image formation section B and media storage section C, and adjacent to the housing 2 is disposed a discharge section D to which the image-recorded card is discharged.

[Media Supply Section]

The media supply section C is provided with a card cassette 3 attached detachably to a cassette installation area of the apparatus housing 2, and a plurality of cards is stored in the card cassette 3. The card cassette 3 shown in FIG. 1 aligns a plurality of cards in an upright position to store, and feeds the card from the right direction to the left direction as viewed in FIG. 1 with a support member 12. Then, a separation opening 7 is provided at the front end of the card cassette 3, and starting with the card in the front row, the cards are supplied inside the apparatus with a pickup roller 19.

[Information Recording Section]

The information recording section A is provided with a reverse unit F, and the card fed from the card cassette 3 is fed to the reverse unit F with a pair of carry-in rollers 6. The reverse unit F is bearing-supported by an apparatus frame (not shown) to be turnable, and inside is disposed a pair of roller pairs 20, 21 opposed in the horizontal direction. Then, the reverse unit F turns a predetermined angle by a drive motor such as a pulse motor, and corresponding thereto, the roller pairs 20, 21 are also displaced at the same angle. In this case, by switching using a clutch, it is possible to share the same drive motor for turning movement of the reverse unit F and rotation of the roller pairs. The reverse unit F is provided with a home position sensor, not shown, and a position where the home position sensor is turned ON is a reference position in turning the reverse unit F. Further, the drive motor of the reverse unit F is provided with an encoder that detects a rotation amount of the drive motor, and by measuring an input value of the encoder from the state in which the home position sensor is turned ON, it is possible to control an angle of the turning movement of the reverse unit F.

The reverse unit F is positioned so that a line segment joining the roller pairs 20, 21 is opposed to the separation opening 7. When a sensor S1 detects a fed card, the card is introduced inside the reverse unit F by rotation of the roller pairs 20, 21, and is nipped by the roller pairs 20, 21 to be held. Accordingly, the roller pairs 20, 21 form a media carry-in path 28.

In an outer region in the turning direction of the reverse unit F are disposed a non-contact type IC recording section 23, magnetic recording section 24 and contact type IC recording section 27. Then, sensors S5, S6, S7 are disposed respectively on the entrance sides of the recording sections 23, 24, 27. The reverse unit F rotates so that the media carry-in path 28 is communicated with one of these information recording sections 23, 24, 27, and by driving the roller pairs 20, 21, sends out the card to one of communicated information recording sections 23, 24, 27.

When the card is carried to the magnetic recording section 24, non-contact type IC recording section 23, or contact type IC recording section 27, information is recorded with magnetic data or electronic data. Then, after inputting the data, the card is taken in the reverse unit F again by the roller pairs 20, 21. In addition, other than these magnetic recording section 24, non-contact type IC recording section 23, and contact type IC recording section 27, the information recording section A may be comprised of various kinds of recording sections, for example, such as a barcode recording section, corresponding to apparatus specifications.

In order to feed the data-input card to the image formation section B in the subsequent stage, the reverse unit F rotates to be a state shown in FIG. 1, so that the media carry-in path 28 is communicated with a transport path 15. The transport path 15 is media transport means for transporting the card in the horizontal direction by roller pairs 29, 30, 35, 36 and a pair of contact rollers 22*a*, 22*b* described later. At this point, a sensor S2 detects the card which is transported from the media carry-in path 28 to the transport path 15.

[Image Formation Section]

The image formation section B forms images of a face photo, text data and the like on the surface of the card. The image formation section B is provided with a first transfer section 16 that transfers the image to a transfer film 46 with an ink ribbon 46, and a second transfer section 14 that transfers the image to the card from the transfer film 46.

The transfer in the first transfer section 16 is performed by a platen roller 45, and a thermal head 40 disposed opposite the platen. Between the platen roller 45 and the thermal head 40 travel the sublimation type ink ribbon 41 supplied from a ribbon cassette 42 and the transfer film 46 supplied from a film cassette 50.

The transfer film 46 is wound around a supply spool 47 and a winding spool 48 in the film cassette 50, and the film carry path described previously is formed between the supply spool 47 and the winding spool 48. Then, the supply spool 47 is coupled to a feeding motor Mr2, and the winding spool 48 is coupled to a winding motor Mr3. Both of the motors are coupled to a spool shaft via coupling means attached to the apparatus frame, and each of the motors is comprised of a stepping motor, and rotates in the same direction by the same feed amount.

In the carry path of the transfer film 46 between the supply spool 47 and the winding spool 48, a carry roller 49 and pinch rollers 32*a*, 32*b* are disposed, and the transfer film 46 is transported on the film carry path by press-contact between the carry roller 49 and the pinch rollers 32*a*, 32*b*. The carry roller 49 is coupled to a carry roller drive motor 65 (see FIG. 4), and causes the transfer film 46 to travel at a certain velocity. At this point, a sensor Se2 detects marks formed at predetermined intervals on the transfer film 46. At the time of image formation to the transfer film 46, the carry roller 49 is configured so that the ink ribbon 41 and the transfer film 46 rotate at the same velocity in a counterclockwise direction shown in FIG. 1.

On the other hand, the ink ribbon 41 is stored in the ribbon cassette 42. Into the ribbon cassette 42 are incorporated the supply spool 43 and winding spool 44 constituting the ink ribbon transport means, and the winding spool 44 is coupled to an ink ribbon wind motor Mr1. The film-shaped ink ribbon 41 is wound between both of the spools 43, 44. The ink ribbon 41 is the sublimation type ribbon, and is formed by sequentially arranging respective ink panel faces of Y (Yellow)•M (Magenta)•C (Cyan)•B (Black) in the shape of a band, and each ink panel face has a predetermined width corresponding to a printing width of the transfer film 46. A sensor Se1 detects a position of the ink ribbon 41 transported by drive of the winding spool 44.

The ribbon cassette 42 is installed in the apparatus housing 2 detachably in the frontside-backside direction on the paper of FIG. 1, and the ink ribbon 41 is inserted between the platen roller 45 and the thermal head 40 for image formation. The transfer film 46 is removed from the supply spool 47, and is carried to a feeding position of image transfer by rotation of the carry roller 49 in a clockwise direction. At this point, the ink ribbon 41 is also carried to the feeding position by the winding spool 44 rotating in the counterclockwise direction. Accordingly, in this operation, carry directions of the transfer film 46 and the ink ribbon 41 are opposite.

When the transfer film 46 and the ink ribbon 41 are aligned in the feeding position, the platen roller 45 shifts toward the thermal head 40 by a platen roller shift drive section 66 (see FIG. 4) using a push mechanism, not shown, and is brought into contact with the thermal head 40, while nipping the transfer film 46 and the ink ribbon 41. A head control IC 68 (see FIG. 4) is connected to the thermal head 40, and performs thermal control on the thermal head 40. The head control IC 68 performs thermal control on the thermal head 40, according to image data transmitted from an upper apparatus 11 such as a host computer, together with a transfer command. In addition, a cooling fan f1 is provided to cool the thermal head 40.

The winding spool 44 rotates in synchronization with thermal control of the thermal head 40, and shifts the ink ribbon 41 in the winding direction at a predetermined velocity. At this point, the carry roller 49 rotates in the counterclockwise direction to carry the transfer film 46 in the same direction as that of the ink ribbon 41 by a portion corresponding to a printing width of a single sheet of the card, and the image is thereby formed in this portion. Then, when the image transfer by a single ink panel is finished, the carry roller 49 rotates again in the clockwise direction, and draws back the transfer film 46 to the feeding position by the portion corresponding to the printing width of the single sheet of the card. At this point, since the ink ribbon 41 is continuously carried in the winding direction, the next ink panel is aligned with the transfer film 46 in the feeding position.

In such feeding control, with respect to each ink panel of Y (Yellow), M (Magenta), C (Cyan) and B (Black), the alignment with the transfer film 46 in the feeding position is sequentially performed, heating transfer by the thermal head 40 and the platen roller 45 is repeated after the alignment, and the images of a face photo, text data and the like to transfer to the frontside and backside of the card are thereby transferred to the transfer film 46.

Transfer in the second transfer section 14 is performed with a transfer platen 31 and a heating roller 33, and after forming the image on the transfer film 46, the portion where the image is formed in the first transfer of the transfer film 46 and the card are positioned between the transfer platen 31 and the heating roller 33. Then, the heating roller 33 is moved up to a position brought into press-contact with the transfer platen 31 by an up-and-down drive section 13 (see FIG. 13), the card and the transfer film 46 are concurrently pressed and heated, the image ink formed on the transfer film 46 is thereby heated and fused into the recording card, and the image is transferred to the surface of the card.

In the image formation section B, in addition to the first transfer section 16 and second transfer section 14, a cleaning section 5 and a skew correction section 38 are disposed on the transport path 15.

[Cleaning Section]

The cleaning section 5 is positioned on the transport path 15 and in a position nearer (roller pair 21 in the figure) one group of roller pairs 20, 21, and is therefore disposed at a distance within the dimension of the card in the longitudinal direction. Then, the cleaning section 5 is provided with a pair of contact rollers 22*a*, 22*b* disposed with the transport path 15 therebetween, and a cleaning roller Rc disposed in contact with the contact roller 22*a*. Each of the contact rollers 22*a*, 22*b* and cleaning roller Rc is comprised of a roller body having stickiness on its surface, and a rotating shaft integrated with the roller body. The cleaning section 5 is disposed between the roller pair 29 and the roller pair 30 on the transport path 15. Accordingly, in cleaning the card, since it is possible to transport until the card rear end (upstream-side end portion in the transport direction) passes through the cleaning section 5, it is possible to clean the entire card surface.

When the card passes through between the contact rollers 22*a*, 22*b*, dust of the surface is adsorbed by the contact rollers 22*a*, 22*b*, and is removed. At this point, since the cleaning roller Rc rotates in conjunction with the contact rollers 22*a*, 22*b*, the dust, which is removed from the card and adheres to the surfaces of the contact rollers 22*a*, 22*b*, further adheres to the cleaning roller Rc, and the contact rollers 22*a*, 22*b* are also cleaned at the same time. Accordingly, viscosities of these three types of roller surfaces are set so that the viscosity increases in order of the contact roller 22*b*• the contact roller 22*a*• the cleaning roller Rc, and the viscosity of the cleaning roller Rc is the highest.

Figure 2:
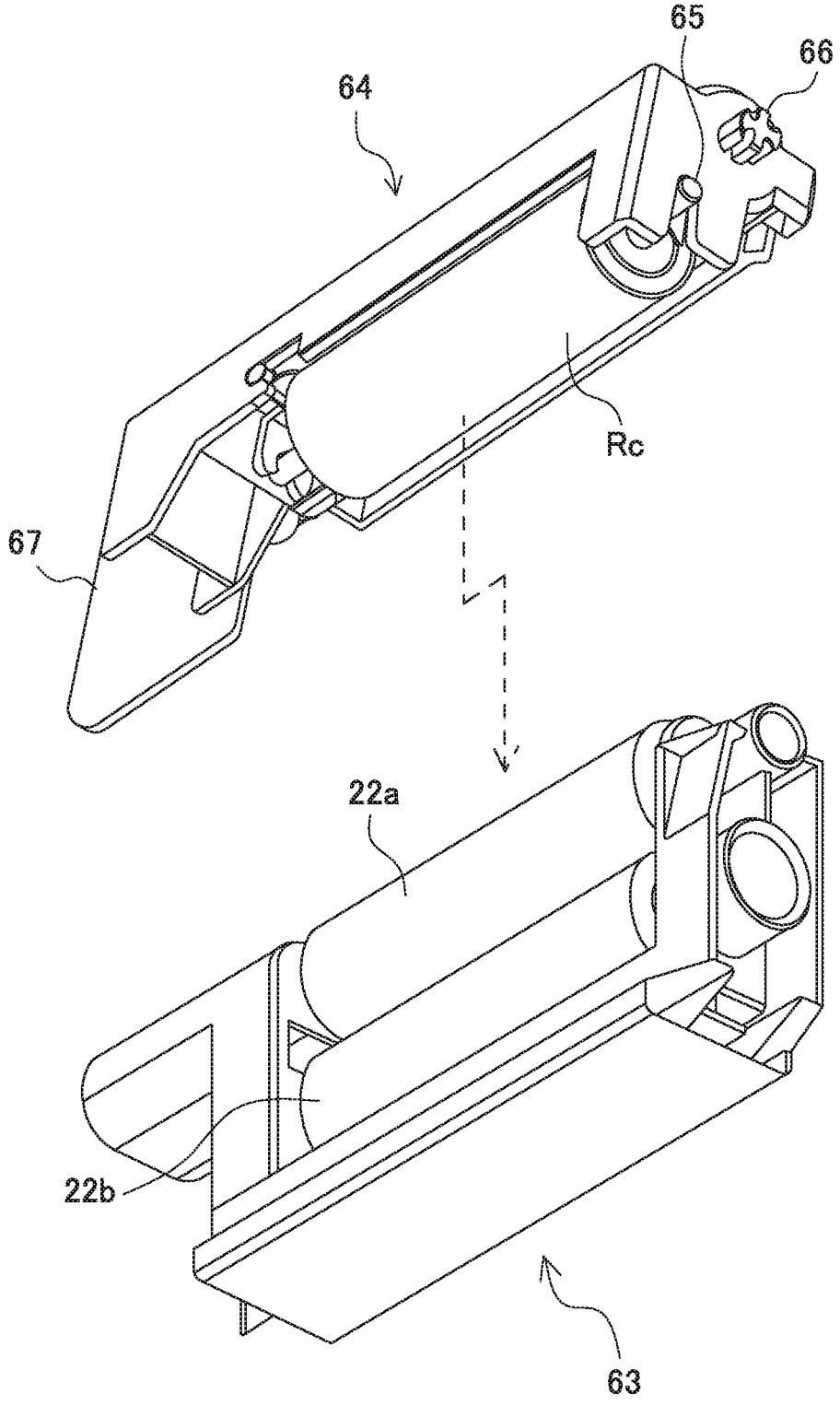
FIG. 2 illustrates an explanatory view of a cleaning section in the recording apparatus of FIG. 1.

The contact rollers 22*a*, 22*b* and cleaning roller Rc are respectively stored in holder members, and are detachable from the apparatus for each of the holder members by cartridge form. As shown in FIG. 2, the holder member for holding the contact rollers 22*a*, 22*b* together constitutes a cartridge 63. A cartridge 64 stores the cleaning roller Rc. The cartridge 63 is incorporated into the recording apparatus 1 so that the transport path 15 passes between the contact roller 22*a* and the contact roller 22*b*, and the cartridge 64 is incorporated into the recording apparatus 1 so that the cleaning roller Rc comes into contact with the contact roller 22*a*.

The cartridge 64 is capable of separating the cleaning roller Rc from the surface of the contact roller 22, by operating a lever 67 to swing, against a press-contact spring not shown, around a spindle 66 different from the rotating shaft 65 of the cleaning roller Rc. Then, it is possible to remove cartridges 63, 64 from the recording apparatus 1 independently, and it is made possible to easily perform replacement and maintenance.

[Skew Correction Section]

Figure 3A:
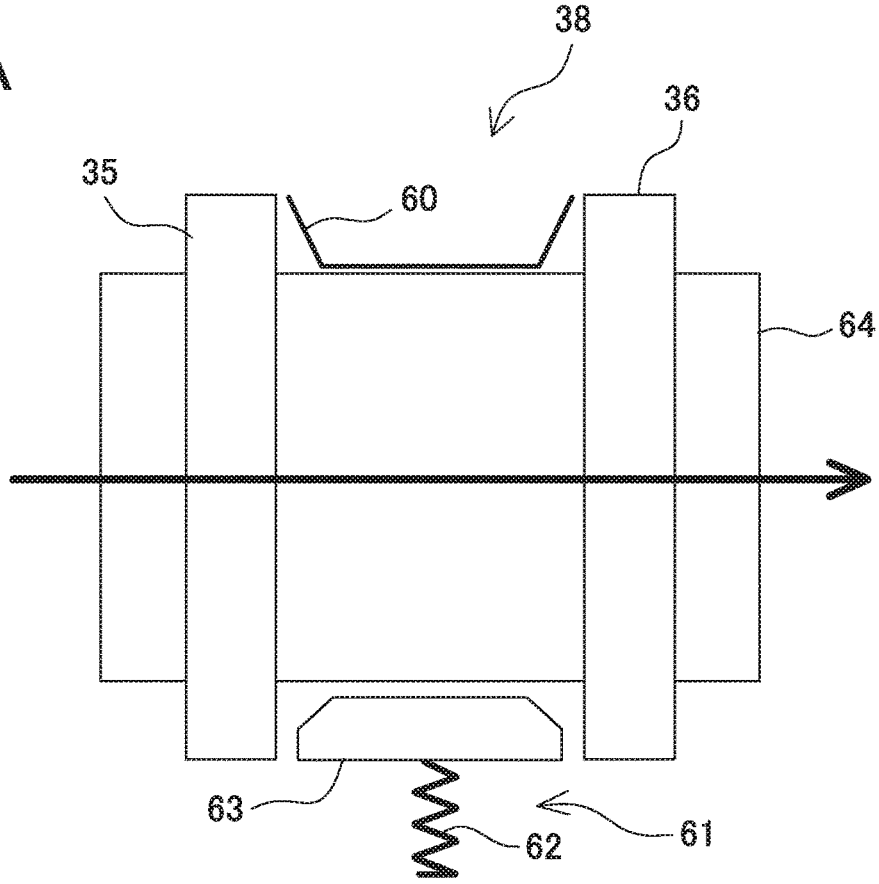
FIGS. 3A and 3B illustrate explanatory views of a skew correction section in the recording apparatus of FIG. 1.
Figure 3B:
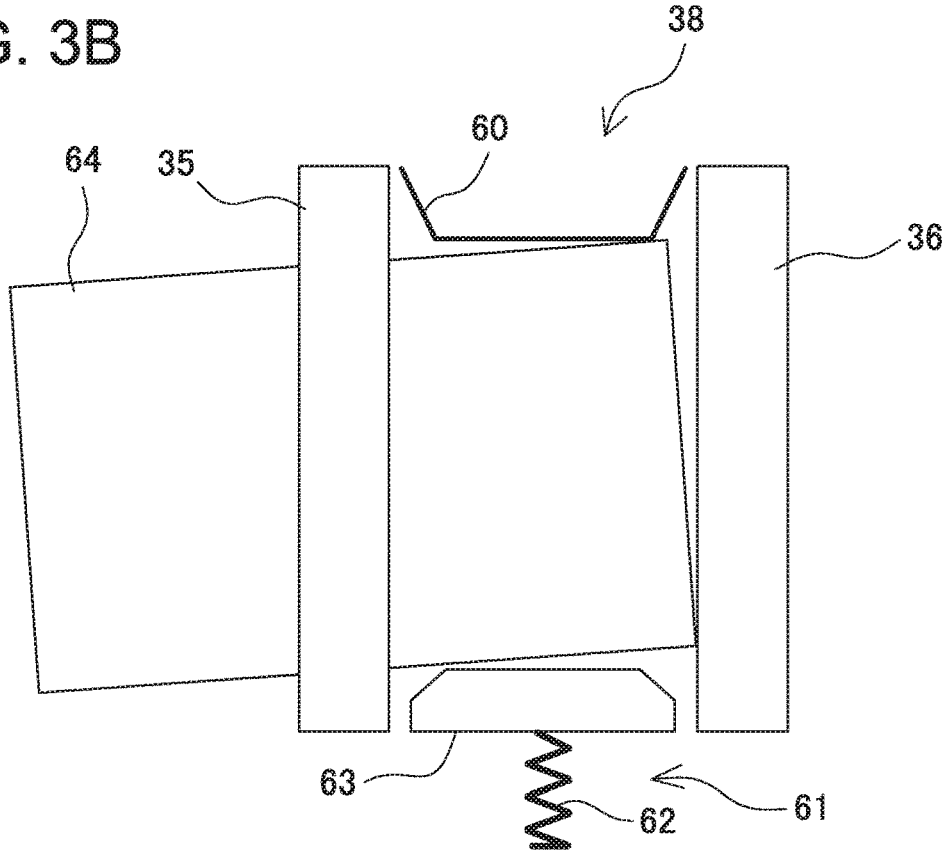

To correct a skewed card, the skew correction section 38 is disposed on the transport path 15 at a distance within the dimension of the card in the longitudinal direction from the cleaning section 5. As shown in FIGS. 3A and 3B, in the skew correction section 38, one group of transport roller pairs 35, 36 is provided in the transport path 15 to respectively nip the card, and between the roller pairs 35, 36, along the transport direction of the card, a guide member 60 for skew correction is disposed on one side of the transport path 15, while a width aligning member 61 for skew correction is disposed opposite the guide member 60 on the other side. Then, the width aligning member 61 performs width aligning on a card 64 passing on the transport path 15 toward the guide member 63 by pressing pressure of a biasing member 62 comprised of a spring or the like.

The nip force on the card 64 by the transport roller pair 36 is set to be higher than the nip force by the transport roller pair 35. It is possible to make such a setting by adjusting the dimension between a pair of rollers, the roller diameter and the like. Accordingly, as shown in FIG. 3B, with respect to the card 64 fed in a skewed state, when the width aligning member 61 performs width aligning toward the guide member 63, since the nip force of the transport roller pair 35 is weak, the card 64 is moved by biasing of the width aligning, and is transported, while being corrected so as to coincide with the transport direction a as shown in FIG. 3A.

[Discharge Section]

The discharge section D is disposed, while being adjacent to the apparatus housing 2, and is configured to stack cards of which transfer is finished and which are fed through the transport path 15 on a storage stacker 55 to store. The storage stacker 55 is configured to shift downward by an up-and-down mechanism 56, corresponding to a position of the uppermost card detected by a level sensor not shown.

[Control Configuration]

Figure 4:
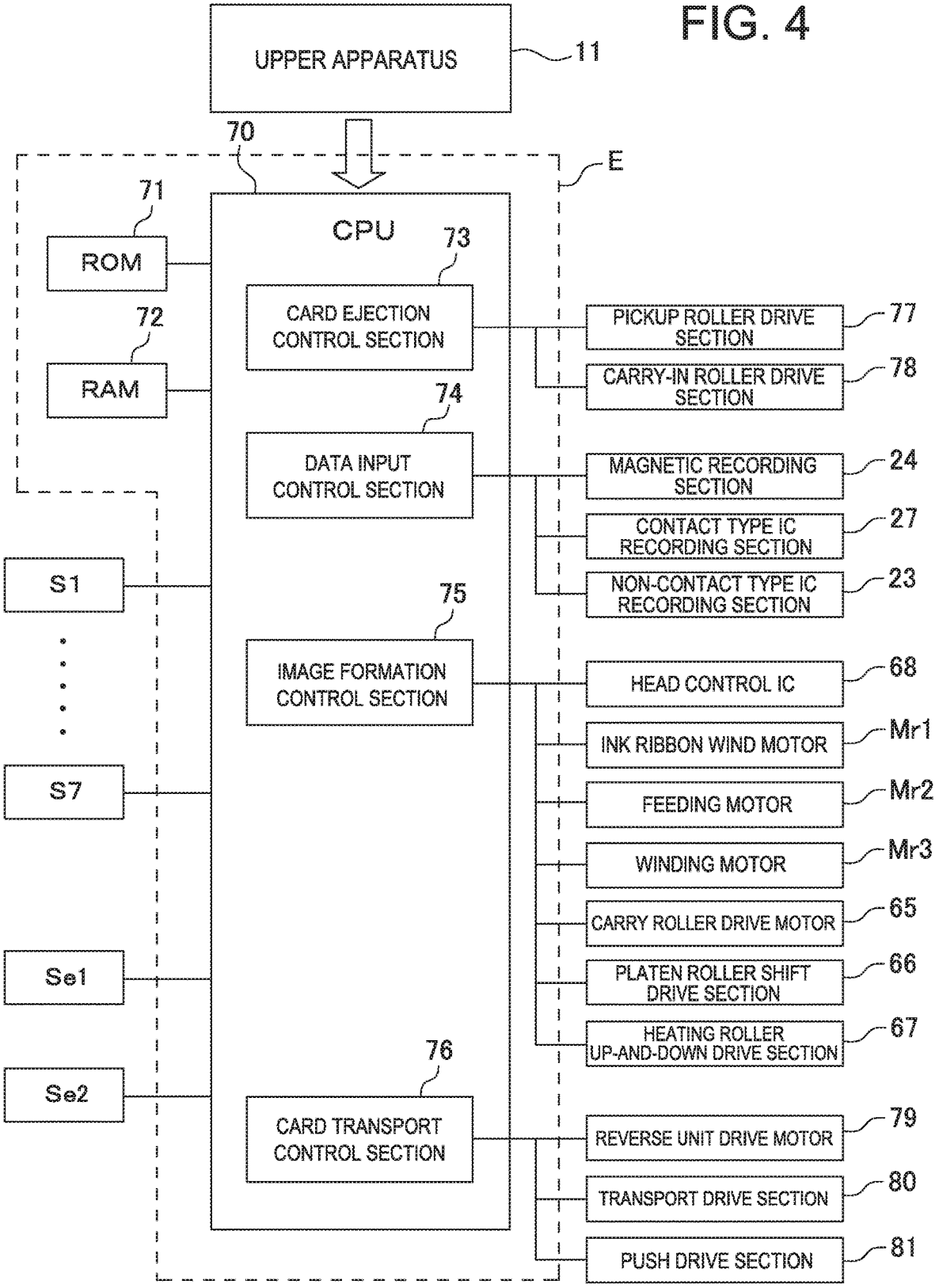
FIG. 4 illustrates electric connection of each section of the recording apparatus of FIG. 1 in a block diagram.

FIG. 4 illustrates electric connection of each section of the recording apparatus 1 in a block diagram. A control section E is comprised of a computer, and is provided with components, i.e., CPU 70, ROM 71, RAM 72 for storing variable data and the like, which a general computer is provided with, and the CPU 70 executes control programs stored in the ROM, and thereby actualizes each function of a card ejection control section 73, data input control section 74, image formation control section 75, and card transport control section 76. The each function will be described below.

The card ejection control section 73 outputs control signals respectively to a pickup roller drive section 77 and carry-in roller drive section 78 to drive the pickup roller 19 and carry-in roller pair 6, and controls ejection of the card from the card cassette 3 of the media supply section C.

The data input control section 74 controls so as to write data transmitted from the upper apparatus 11 such as a host computer of the recording apparatus 1 into the magnetic recording section 24, contact type IC recording section 27, or non-contact type IC recording section 23.

The image formation control section 75 outputs image data transmitted from the upper apparatus 11 together with a transfer command to the head control IC 68. Further, the image formation control section 75 outputs drive signals at predetermined timing according to the control program, operates the ink ribbon wind motor Mr1, feeding motor Mr2, winding motor Mr3, shift roller drive motor 65, platen roller shift drive section 66, and heating roller up-and-down drive section 67, and thereby controls first transfer and second transfer.

The card transport control section 76 controls drive of a reverse unit drive motor 79 to rotate the reverse unit F. At this point, corresponding to an operation mode of the recording apparatus 1, the card transport control section 76 controls a rotation angle so that the media carry-in path 28 faces one of the magnetic recording section 24, contact type IC recording section 27, non-contact type IC recording section 23, separation opening 7 of the card cassette 3 and transport path 15. Further, corresponding to detection signals of the card output from the sensors S2 to S4, the card transport control section 76 outputs a control signal to a transport drive section 80 that drives a series of roller pairs 29, 30, 35, 36 disposed in the transport path 15, a pair of contact rollers 22*a*, 22*b* and roller pairs 20, 21 inside the reverse unit F, and controls transport of the card in the transport path 15.

Figure 5:
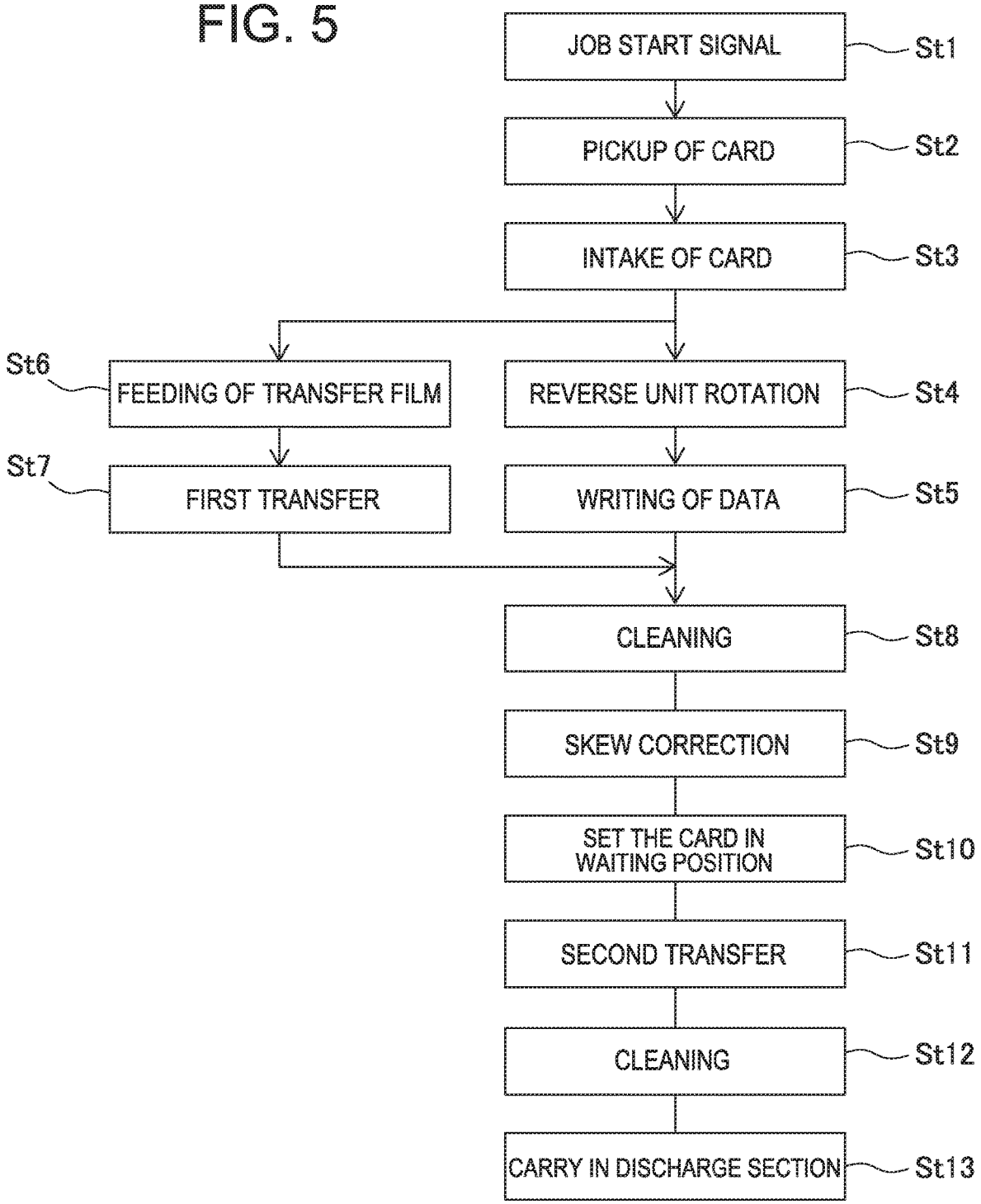
FIG. 5 illustrates an operation flowchart of the recording apparatus of FIG. 1.

Operation for transferring the image to the card by the recording apparatus 1 with the above-mentioned configuration will be described based on a flowchart of FIG. 5.

Upon receiving a job start signal from the upper apparatus 11 (step St1), the control section E outputs a drive signal to the pickup roller drive section 77 with the card ejection control section 73, and picks up a card from the media supply section C (step St2). At the same time, the card ejection control section 73 outputs a drive signal to the carry-in roller drive section 78 to operate the roller pairs 20, 21, and takes the card fed out from the media supply section C into the media carry-in path 28 inside the reverse unit F (step St3). Then, when the entrance sensor S1 detects the fed card, the card ejection control section 73 halts output of the drive signal to the carry-in roller drive section 78. Next, when the entrance sensor S1 does not detect the card again, the section 73 halts output of the drive signal to the carry-in roller drive section 78. Accordingly, a single sheet of card is ejected from the media supply section C. At this point, the reverse unit F directs the media carry-in path 28 toward the separation opening 7 of the card cassette 3, and the ejected card is introduced into the reverse unit F, and is held inside the media carry-in path 28.

When the card is ejected from the media supply section C, the card transport control section 76 outputs a drive signal to the reverse unit drive motor 79 so that the media carry-in path 28 faces one of the magnetic recording section 24, non-contact type IC recording section 23 and contact type IC recording section 27 that the upper apparatus 11 designates to write the data, and rotates the reverse unit F at a predetermined rotation angle (step St4).

When the reverse unit F rotates, the data input control section 74 controls so that the data concurrently transmitted from the upper apparatus 11 is written into the card (step St5). In this case, when the magnetic recording section 24 or the contact type IC recording section 27 is used, the card transport control section 76 outputs a drive signal to the transport drive section 80 to drive the roller pairs 20, 21, feeds the card to the recording section 24 or 27 from the media carry-in path 28, and after finishing writing, drives the roller pairs 20, 21 in the intake direction to receive the card. At this point, the card transport control section 76 detects coming and going of the card from/to the media carry-in path 28 by sensors S6, S7. In writing into the non-contact type IC recording section 23, while keeping the card in the media carry-in path 28, the data is transmitted with a radio signal to perform writing.

In parallel with the writing of the data into the card, the image formation control section 75 feeds the transfer film 46 to the thermal head 40 (step St6). Feeding of the transfer film 46 is performed by controlling rotation of the feeding motor Mr2 and winding motor Mr3, and the film sensor Se2 detects a feeding amount. The transfer film 46 is provided with a mark for each frame with a predetermined width corresponding to a printing width of a region for forming the image on the card, and the section 75 detects the mark with the sensor Se2, and controls a feeding amount of the film.

Upon feeding the transfer film 46, the image formation control section 75 transfers the image data transmitted from the upper apparatus 11 to the head control IC 68, while controlling the ink ribbon wind motor Mr1, shift roller drive motor 65, and platen roller shift drive section 66, and performs first transfer on the transfer film 46 (step St7). In performing the first transfer, the image formation control section 75 controls forward/backward rotation of the carry roller drive motor 65 and drive of the ink ribbon wind motor Mr1 corresponding to a detection signal of the mark from the sensor Se2, and each color of Y (Yellow), M (Magenta), C (Cyan) and B (Black) of the ink ribbon 41 is thereby transferred to the transfer film 46, according to the image data. Then, after the first transfer, the transfer film 46 waits in a waiting position where the front end of the transferred portion is detected by the sensor Se2.

When both writing of the data into the card and first transfer is finished, the card transport control section 76 outputs a drive signal to the transport drive section 80 to drive the roller pairs 20, 21, while driving a series of roller pairs 29, 30, 35, 36 disposed in the transport path 15 and a pair of contact rollers 22*a*, 22*b*, and directs the card in the direction of the sensor S4 to transport to the right direction in the figure. In the following description, for convenience in writing, it will be described that rotation of each roller pair to transport the card to the right direction (positive direction) is forward rotation, and that rotation of each roller pair to transport to the left direction (opposite direction) is backward rotation.

By forward rotation of the roller pairs 20, 21 and roller pair 29, the card held in the media carry-in path 28 is removed from the reverse unit F, and for a period during which the card passes through the cleaning section 5 further by forward rotation of the contact rollers 22*a*, 22*b*, cleaning is performed on the card surface (step St8). When the card passes through the cleaning section 5, the card passes between the transfer platen 31 and the heating roller 33, but second transfer is not performed at this point. Accordingly, stains such as dust adhering to the card before transferring the image are removed in this stage.

Then, by continuing forward rotation of the roller pairs 30, 35, 36, the cleaned card is transported in the positive direction without change, and passes through the skew correction section 38. At this point, the card transport control section 76 outputs a drive signal to a push drive section 81 to push the width aligning member 61 toward the card, and the skewed card is thereby corrected (step St9).

When skew correction is finished and the sensor S4 detects the front end of the card, the card transport control section 76 outputs a drive signal to the transport drive section 80 so as to rotate the roller pairs 30, 35, 36 backward, and transports the card in the opposite direction. Then, when the sensor S3 detects the card transported backward, the card transport control section 76 halts driving of the roller pairs 30, 35, 36 (step St10). Accordingly, the card stops in a waiting position prior to second transfer processing.

In stopping the card in the waiting position of second transfer, when the first transfer in the image formation section B is finished and the transfer film 46 is also set in a predetermined waiting position of the travel path, the card transport control section 76 controls the transport drive section 80, rotates the roller pairs 29, 30, 35 and contact rollers 22*a*, 22*b* backward, and drives so as to transport toward the platen roller 31. In synchronization therewith, the image formation control section 75 drives the feeding motor Mr2 and carry roller drive motor 65 so as to transport the first-transferred portion of the transfer film 46 toward the platen roller 31, while driving the heating roller up-and-down drive section 67, and pushes the heating roller 33 to the transfer platen 31. In this case, the image formation control section 75 controls rotation of the feeding motor Mr2 in the direction of winding up the transfer film 46. By this means, the transfer film 46 and the card concurrently pass between the heating roller 33 and the transfer platen 31, and second transfer is thereby performed (step St11).

After the second transfer, transport of the card in the opposite direction is continued, and the card passes between the contact rollers 22*a*, 22*b*. By this means, cleaning of the card surface is performed again (step St12). In cleaning at this point, removed are a peeling residue of the transfer film 46 and the like adhering to the card after the transfer.

When the sensor S2 detects the card transported backward, the card transport control section 76 rotates the roller pairs 20, 21 backward, and thereby passes the card through the media carry-in path 28 to carry in the discharge section D (step St13).

Further, when the sensor S2 detects the card, the image formation control section 75 controls the heating roller up-and-down drive section 67 so as to shift the heating roller 33 in the direction for separating from the transfer platen 31. Concurrently therewith, the image formation control section 75 drives the winding motor Mr3, and controls winding of the transfer film 46 so that the portion of the transfer film 46 used in transfer to the card shifts to a position separating from the platen roller 45 toward the winding spool 48. By this means, a portion of the transfer film 46 undergoing next first transfer is set between the platen roller 45 and the thermal head 40.

As described above, by arranging the cleaning section 5 on the transport path 15, the card ejected from the media storage section C is first transported in the positive direction, and passes through the cleaning section 5, second transfer section comprised of the heating roller 33 and transport roller 31, and skew correction section 38. Then, the card is transported in the opposite direction, and after transfer processing in the second transfer section, is transported to the discharge section D again through the cleaning section 5. Therefore, in either of cases prior to the transfer processing and subsequent to the processing, the card passes through the cleaning section 5 and is cleaned.

In the recording apparatus of this Embodiment, the card storage section C is disposed in the upper portion of the apparatus, and the reverse unit F is disposed below the card storage section C. Then, the cleaning section 5 is disposed between the reverse unit F and the image formation section B, and the discharge section D is disposed on the side opposite to the image formation section B with respect to the reverse unit F. By this configuration, (in the case of only one-sided printing without performing information recording processing), after supplying the card from the card storage section C, only by performing one reciprocating along the transport path 15, it is possible to perform cleaning, transfer processing and discharge of the card, and it is possible to execute efficient processing.

Figure 6:
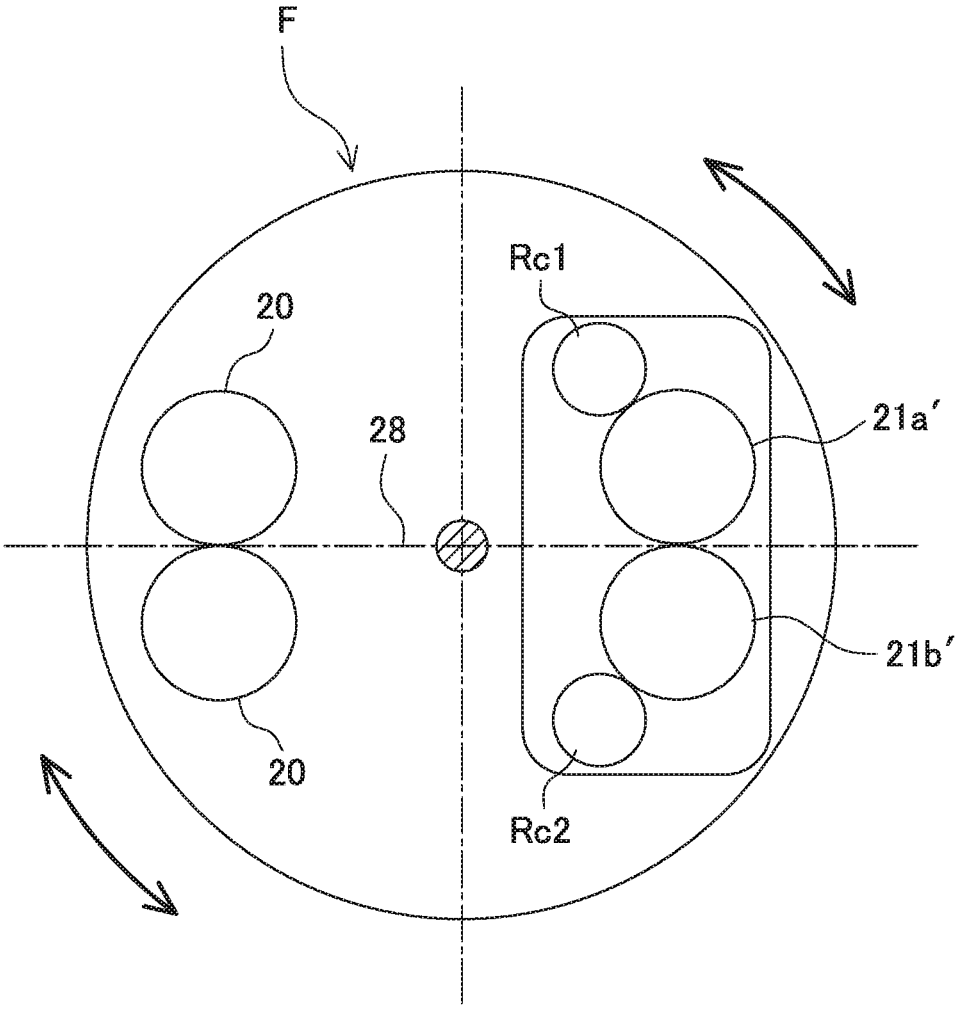
FIG. 6 illustrates an explanatory view of a modification example of the cleaning section in the recording apparatus of FIG. 1.

As shown in FIG. 6, the cleaning section 5 may be disposed inside the reverse unit F. In this case, one of the roller pairs 20, 21, the roller pair 21 in the figure, forming the media carry-in path 28 is made contact rollers 21*a*', 21*b*' of the cleaning section 5. Accordingly, at either of the time the card is transported in the positive direction from inside the reverse unit F and the time the card is transported backward after transfer and is carried in the discharge section D, the card passes through the contact rollers 21*a*' and 21*b*', and cleaning is thereby performed in either of cases prior to and subsequent to the transfer processing.

Further, in this Modification, provided are cleaning rollers Rc1, Rc2 that rotate in contact with contact rollers 21*a*', 21*b*' respectively. Accordingly, the card ejected from the media storage section C is fed from the contact rollers 21*a*', 21*b*' at either of the time the card is fed to the transfer section from the reverse unit F and the time the card passes through the media carry-in path 28 of the reverse unit F after transfer, and therefore, cleaning before and after transfer is performed.

In this Modification, when the reverse unit F receives the card, in the case of receiving the card from the contact rollers 21*a*', 21*b*' side, there is an effect that dust is not left inside the reverse unit F. Accordingly, the card transport control section 76 controls the drive motor 79 of the reverse unit F so as to receive the card, by directing the contact rollers 21*a*', 21*b*' toward the media storage C side in supplying the card, while directing the contact rollers 21*a*', 21*b*' toward the transfer section 14 side in moving the card into the reverse unit F after finishing the transfer processing.

Further, in this Modification, card transport members on the opposite sides of the contact rollers 21*a*', 21*b* as the cleaning section are the roller pair 29 and roller pair 20, and at the time of card cleaning, by transporting to these roller pairs, it is possible to clean the card entire surface.

In the above-mentioned example, the cleaning section 5 is disposed in the media transport direction in the transfer processing by the transfer section, i.e., on the downstream side in backward transport, and may be disposed on the upstream side, i.e., in the transport path 15 between the skew correction section 38 and the second transfer section. In this configuration, after transporting forward again the card subjected to second transfer by backward transport to pass through the cleaning section 5, transport is further switched to backward transport, and the cleaned card is transported to the discharge section D.

Figure 7:
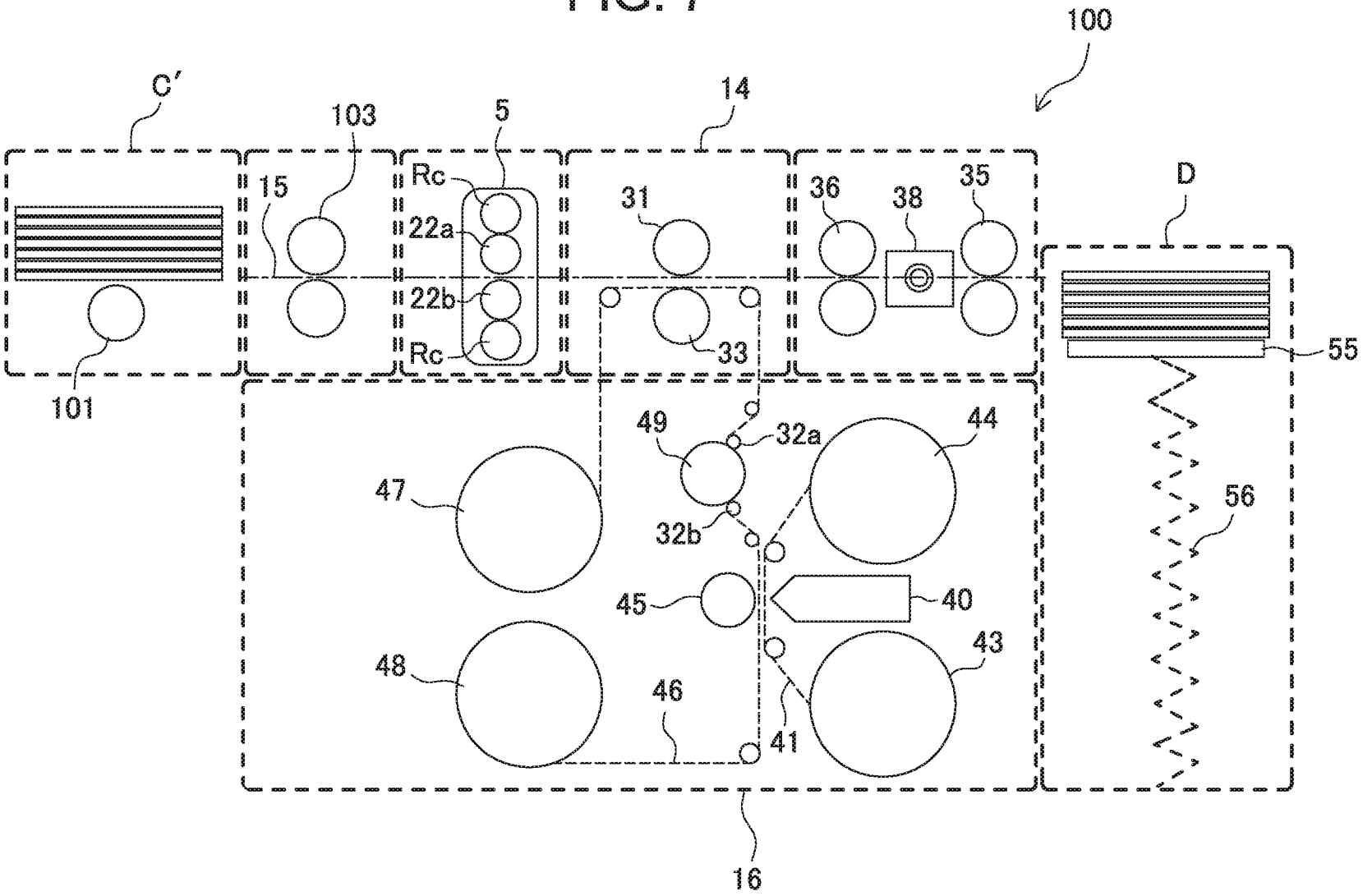
FIG. 7 illustrates a schematic explanatory view of a recording apparatus according to Embodiment 2 of the invention.

FIG. 7 illustrates a configuration of a recording apparatus 100 according to Embodiment 2 of the present invention, and the recording apparatus 100 is not provided with the reverse unit F. In addition, FIG. 7 illustrates only principal structural sections in a representative manner, and the same reference numeral is assigned to the same structural section as in the recording apparatus 1 shown in FIG. 1 to omit detailed descriptions.

A media storage section C' of the recording apparatus 100 stacks cards with information already written magnetically or electrically or cards with no need of writing the information to store, and the lowest card is fed out to the transport path 15 by an ejection roller 101. In the transport path 15 continued to the discharge section D, a sending roller pair 103, cleaning section 5, second transfer section 14 and skew correction section 38 are sequentially disposed. Then, the first transfer section 16 is provided in a position opposed to the second transfer section 14 below the transport path 15. In the cleaning section 5 comprised of a contact roller pair 107, the cleaning roller Rc is disposed in each of the contact rollers 22*a*, 22*b*. Accordingly, the transport path 15 in the recording apparatus 100 transports the card in the horizontal direction with the sending roller pair 103, a pair of contact rollers 22*a*, 22*b* of the cleaning section 5, and roller pairs 35, 36.

In the recording apparatus 100 with the above-mentioned configuration, when the lowest card is ejected to the transport path 15 by the ejection roller 101, by rotating the sending roller pair 103, contact roller pairs 22*a*, 22*b* and roller pairs 35, 36 forward, the card is transported toward the direction of the discharge section D in the figure. Then, the card passes through the contact roller pairs 22*a*, 22*b*, and the card surface is thereby cleaned. Further, the card is transported to the skew correction section 38, and the skewed card is corrected. After skew correction, the card is transported backward in the direction of the media storage section C' by rotation in the opposite direction of the roller pairs 35, 36 and contact roller pairs 22*a*, 22*b*, and after passing through the skew correction section 38, transport in the opposite direction is halted. Then, the card waits in a state of being held by the roller pairs 35, 36.

On the other hand, the transfer film 46 is beforehand overlapped with the ink ribbon 41 and passes between the platen roller 45 and the thermal head 40, and the image to transfer to the card is thereby subjected to first transfer and waits. Then, although not described in detail herein, after aligning the card and the transfer film 46, synchronization is acquired, the card is controlled to pass through the second transfer section 14 toward the left direction in the figure, and the image is transferred to the card. After finishing second transfer, the card is further transported toward the cleaning section 5, and cleaning after the transfer is performed. At this point, the card is transported to the sending roller pair 103, and by transporting until the card rear end (upstream-side end portion in the transport direction) passes through the contact roller pairs 22*a*, 22*b*, it is possible to clean the card entire surface. Then, after finishing cleaning, by rotating again the sending roller pair 103, contact roller pairs 22*a*, 22*b*, and roller pairs 35, 36 forward, the card is directed to the right direction and is transported to the discharge section D.

Thus, also in the recording apparatus 100, by arranging the cleaning section 5 on the transport path 15, the card ejected from the media storage section C' passes through the second transfer section 14 through the cleaning section 5, and is transported to the skew correction section 38, and cleaning of the card prior to transfer is thereby performed. Subsequently, the card is transported backward and passes through the cleaning section 5 after transfer in the second transfer section 14, and cleaning of the card subsequent to transfer is thereby performed.

In addition, this application claims priority from Japanese Patent Application No. 2017-231800 incorporated herein by reference.

The invention claimed is:

1. A recording apparatus for bringing a transfer film with an image formed into press-contact with a medium and thereby transferring the image to the medium, comprising:

a media supply section adapted to supply the medium;

a transfer section adapted to provide transfer processing on the medium supplied from the media supply section;

a discharge section to which the medium transfer-processed at the transfer section is discharged;

a first transport path for transporting the medium from the media supply section to the transfer section;

a second transport path for transporting the medium transfer-processed, from the transfer section to the discharge section; and a cleaning section disposed at a position where the first transport path and the second transport path overlap, the cleaning section being adapted to clean the medium before being transported to the transfer section after being supplied from the media supply section, and to clean the medium before being discharged to the discharge section after being transfer-processed at the transfer section.

2. A recording apparatus for bringing a transfer film with an image formed into press-contact with a medium and thereby transferring the image to the medium, comprising:

a media supply section adapted to supply the medium;

a cleaning section adapted to clean the medium;

a transfer section adapted to provide transfer processing on the medium;

a discharge section to which the medium is discharged;

media transport means for transporting the medium; and a control section to control the media transport means, wherein the cleaning section is disposed between the media supply section and the transfer section and on a downstream side in a media transport direction in the transfer processing by the transfer section, and wherein the control section controls the media transport means so as to transport the medium supplied from the media supply section to the transfer section via the cleaning section, and to transport the medium to the discharge section via the cleaning section after the transfer processing by the transfer section.

3. The recording apparatus according to claim 2, wherein the control section transports the medium from one side of the cleaning section at the time of supplying the medium, and transports the medium from the other side of the cleaning section after the transfer processing.

4. The recording apparatus according to claim 2, wherein the media transport means is disposed on opposite sides of the cleaning section at least in a transport direction of the medium, and the control section transports the medium until an upstream-side end portion of the medium in the transport direction passes through the cleaning section.

5. The recording apparatus according to claim 2, further comprising:

a reverse section adapted to reverse a transport direction of the medium to transport;

wherein the cleaning section is provided between the reverse section and the transfer section.

6. The recording apparatus according to claim 5, wherein the control section transports the medium from the media supply section to discharge to the discharge section through the reverse section, the cleaning section, the transfer section, the cleaning section and the reverse section.

7. The recording apparatus according to claim 5, wherein the reverse section includes a transport roller that transports the medium, a surface of the transport roller is configured to include stickiness, and the cleaning section is comprised of the transport roller.

8. The recording apparatus according to claim 2, further comprising:

a re-removal member adapted to remove dust adhering to the cleaning section.

* * * * *